US010806987B2

(12) United States Patent
Burns

(10) Patent No.: US 10,806,987 B2
(45) Date of Patent: Oct. 20, 2020

(54) BARBELL PAD

(71) Applicant: Latisha Inez Burns, Pittsburgh, PA (US)

(72) Inventor: Latisha Inez Burns, Pittsburgh, PA (US)

( * ) Notice: Subject to any disclaimer, the term of this patent is extended or adjusted under 35 U.S.C. 154(b) by 8 days.

(21) Appl. No.: 15/852,020

(22) Filed: Dec. 22, 2017

(65) Prior Publication Data

US 2019/0001211 A1 Jan. 3, 2019

Related U.S. Application Data

(60) Provisional application No. 62/437,755, filed on Dec. 22, 2016.

(51) Int. Cl.

| | |
|---|---|
| ***A63B 71/00*** | (2006.01) |
| ***A63B 21/00*** | (2006.01) |
| ***A63B 21/072*** | (2006.01) |

(52) U.S. Cl.

CPC ..... *A63B 71/0054* (2013.01); *A63B 21/0724* (2013.01); *A63B 21/4035* (2015.10); *A63B 2071/0063* (2013.01); *A63B 2209/08* (2013.01); *A63B 2209/10* (2013.01)

(58) Field of Classification Search

CPC ..... A63B 21/072–08; A63B 71/0054

See application file for complete search history.

(56) References Cited

U.S. PATENT DOCUMENTS

| | | | | |
|---|---|---|---|---|
| 2,984,486 | A * | 5/1961 | Jones | A63B 59/70 473/568 |
| 4,867,444 | A * | 9/1989 | Castillo | A63B 21/0724 482/106 |
| 5,415,607 | A * | 5/1995 | Carpenter | A63B 21/0728 482/106 |
| 5,867,868 | A * | 2/1999 | Ward | A63B 49/08 16/422 |
| 6,183,400 | B1 * | 2/2001 | Pope | A63B 21/4019 16/422 |
| 6,224,518 | B1 * | 5/2001 | Weiss | A63B 21/078 482/104 |
| 6,604,789 | B1 * | 8/2003 | Downing | A47C 7/546 297/227 |
| 7,175,572 | B2 * | 2/2007 | Stonecipher | A63B 21/0023 482/106 |

(Continued)

FOREIGN PATENT DOCUMENTS

GB 250772 A * 4/1926 ..... D01H 5/46

*Primary Examiner* — Nyca T Nguyen

(74) *Attorney, Agent, or Firm* — Reed Smith LLP

(57) ABSTRACT

A barbell pad having magnets on its inner surface to better secure the barbell pad to the bar portion of a barbell and prevent excessive slippage of the pad relative to the bar during use. The barbell pad has an opening comprising two ends lined with Velcro that allows it to be fit around the bar of a barbell and secured around the circumference of the bar when the Velcro lining the two ends of the opening is connected and magnets on the inner surface of the barbell pad attach to the metal bar's outer surface. Magnets attached the inner surface of a pad or covering can be used to secure the pad or covering to a structure or apparatus to secure the pad or covering to the structure or apparatus and prevent slipping of the pad or covering relative to the structure or apparatus.

5 Claims, 4 Drawing Sheets

(56) References Cited

U.S. PATENT DOCUMENTS 7,494,451 B1 * 2/2009 Ramos ..... A63B 21/0728 482/107
7,736,284 B1 * 6/2010 Andrews ..... A63B 21/072 482/108
8,128,541 B2 * 3/2012 Hartman ..... A63B 21/4017 482/122
8,128,542 B2 * 3/2012 Hartman ..... A63B 15/00 482/122
D688,338 S * 8/2013 Bisson ..... D21/662
8,500,609 B1 * 8/2013 Williams ..... A63C 11/228 135/65
9,662,530 B2 * 5/2017 Dimitrov ..... A63B 21/0728
9,907,993 B2 * 3/2018 Penney ..... A63B 21/4035
10,107,317 B1 * 10/2018 Brasch ..... F16B 2/08
10,245,461 B2 * 4/2019 Bruni ..... A63B 21/062
2001/0024999 A1 * 9/2001 Pappert ..... A63B 21/06 482/105
2001/0052710 A1 * 12/2001 Witherell ..... A63B 21/072 294/137
2006/0064851 A1 * 3/2006 Kincaid ..... A45F 5/1046 16/435
2008/0040891 A1 * 2/2008 Tyler ..... A63B 21/4035 16/421
2009/0275447 A1 * 11/2009 Fishman ..... A63B 21/072 482/139
2012/0129664 A1 * 5/2012 Perry ..... A63B 71/14 482/139
2013/0196824 A1 * 8/2013 Ross ..... A63B 1/005 482/40
2014/0274614 A1 * 9/2014 Newman ..... A63B 21/4035 482/139
2016/0045809 A1 * 2/2016 Jones ..... A63B 71/0054 428/100
2016/0158594 A1 * 6/2016 Penney ..... A63B 21/4035 482/139
2016/0332022 A1 11/2016 Mathews
2018/0021662 A1 * 1/2018 Carpinelli ..... A63B 21/4005 482/104
2018/0264313 A1 * 9/2018 Boysen ..... A63B 21/4035
2019/0059568 A1 * 2/2019 Orlando ..... A46B 9/026

* cited by examiner

BARBELL PAD

CROSS-REFERENCE TO RELATED APPLICATION

This application claims the benefit under 35 U.S.C. § 119(e) of the earlier filing date of U.S. Provisional Patent Application No. 62/437,755 filed on Dec. 22, 2016, the disclosure of which is incorporated by reference herein.

BACKGROUND

This application discloses an invention which is related, generally to pads, covers, surfaces, and other apparatus that are secured to an apparatus and comprise a gripping surface. This application also discloses more specifically an invention which is related, generally to barbell pads and securing a barbell pad to a barbell.

Barbell pads are placed on a barbell to help protect the neck or any other area of the body that is used to withstand heavy resistance. These exercises can include, but are not limited to, squats and hip thrusts. Barbell pads are typically mostly made up of foam material to provide a comfort level to the body part which is being used.

Most barbell pads fit loosely on the barbell and slide back and forth. This can cause low secure placement of the bar when performing exercises. The looseness of the pad produces imbalance when placed on the back of the neck or when performing hip thrusts when the barbell is placed on the top of the thighs. Disclosed herein is a body protection apparatus configured to wrap around a circumference of a bar portion of a barbell such that an inner surface is configured to be in contact with and enclose the bar portion, and wherein the barbell body protection apparatus is configured to protect and comfort at least one of the neck and thighs of a user during exercise with the barbell.

BRIEF DESCRIPTION OF THE DRAWINGS

For the present invention to be clearly understood and readily practiced, the present invention will be described in conjunction with the following figures, wherein like reference characters designate the same or similar elements, which figures is incorporated into and constitutes a part of the specification.

DETAILED DESCRIPTION

Figure 1:
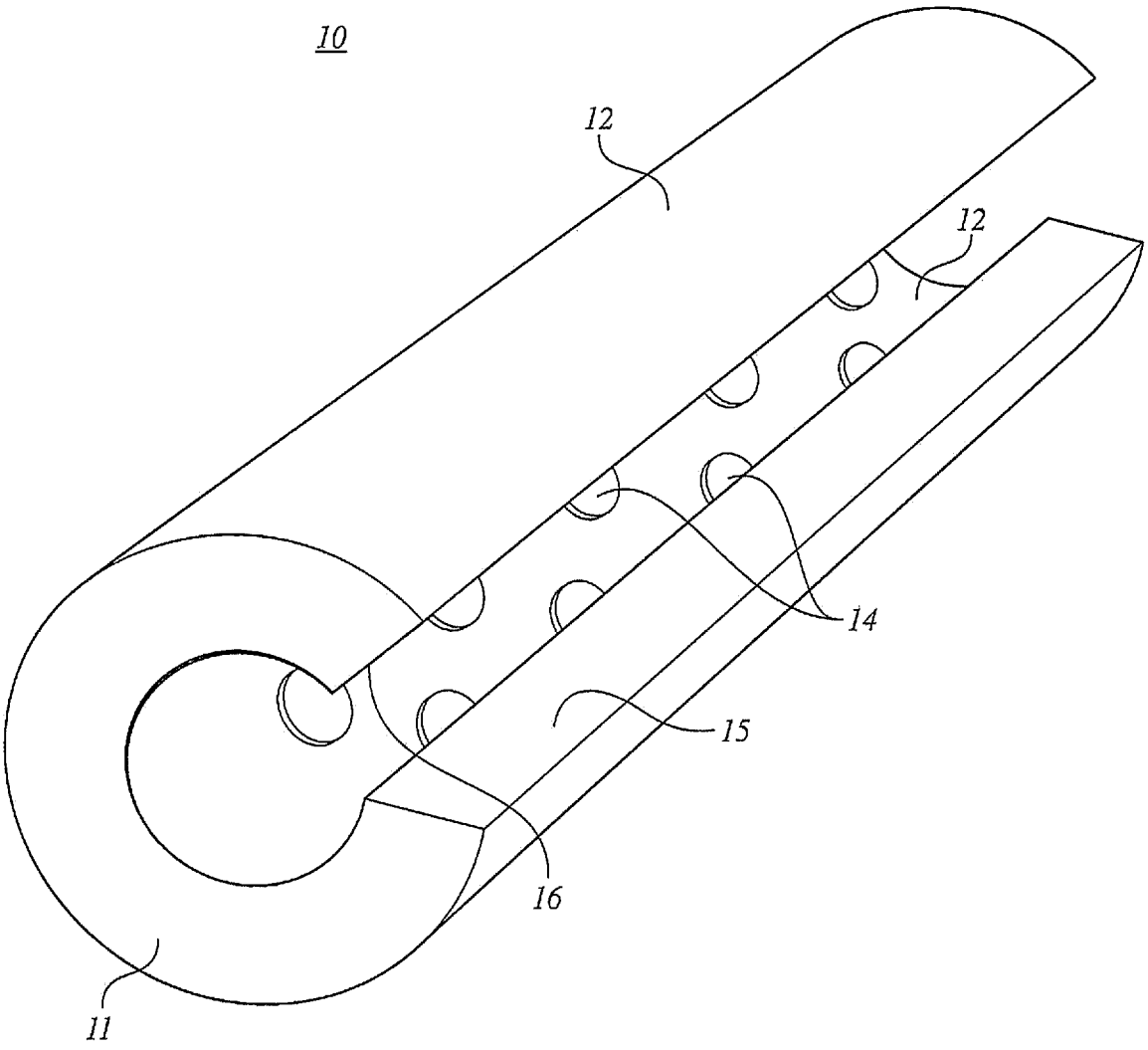
FIG. 1 shows a perspective view of one embodiment of a barbell pad according to the invention.

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the invention. However, because such elements are known in the art, and because they do not facilitate a better understanding of the present invention, a discussion of such elements is not provided herein. The detailed description will be provided herein below with reference to the attached drawings.

For purposes of the description hereinafter, the terms "inner" and "outer", and derivatives thereof shall relate to the invention, as it is oriented in the drawings. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

Figure 2:
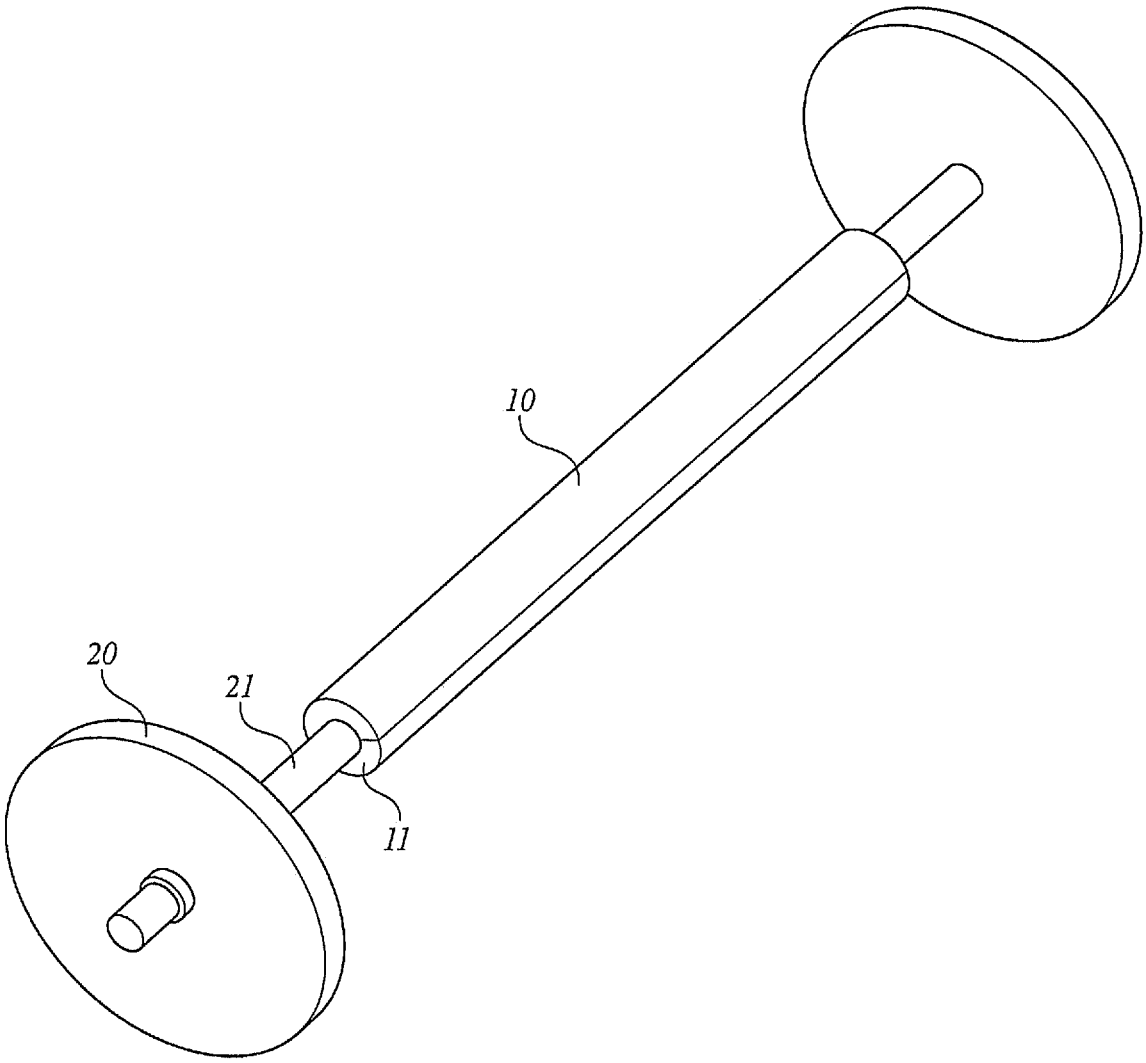
FIG. 2 shows a perspective view of one embodiment of a barbell pad wrapped around a barbell.
Figure 3:
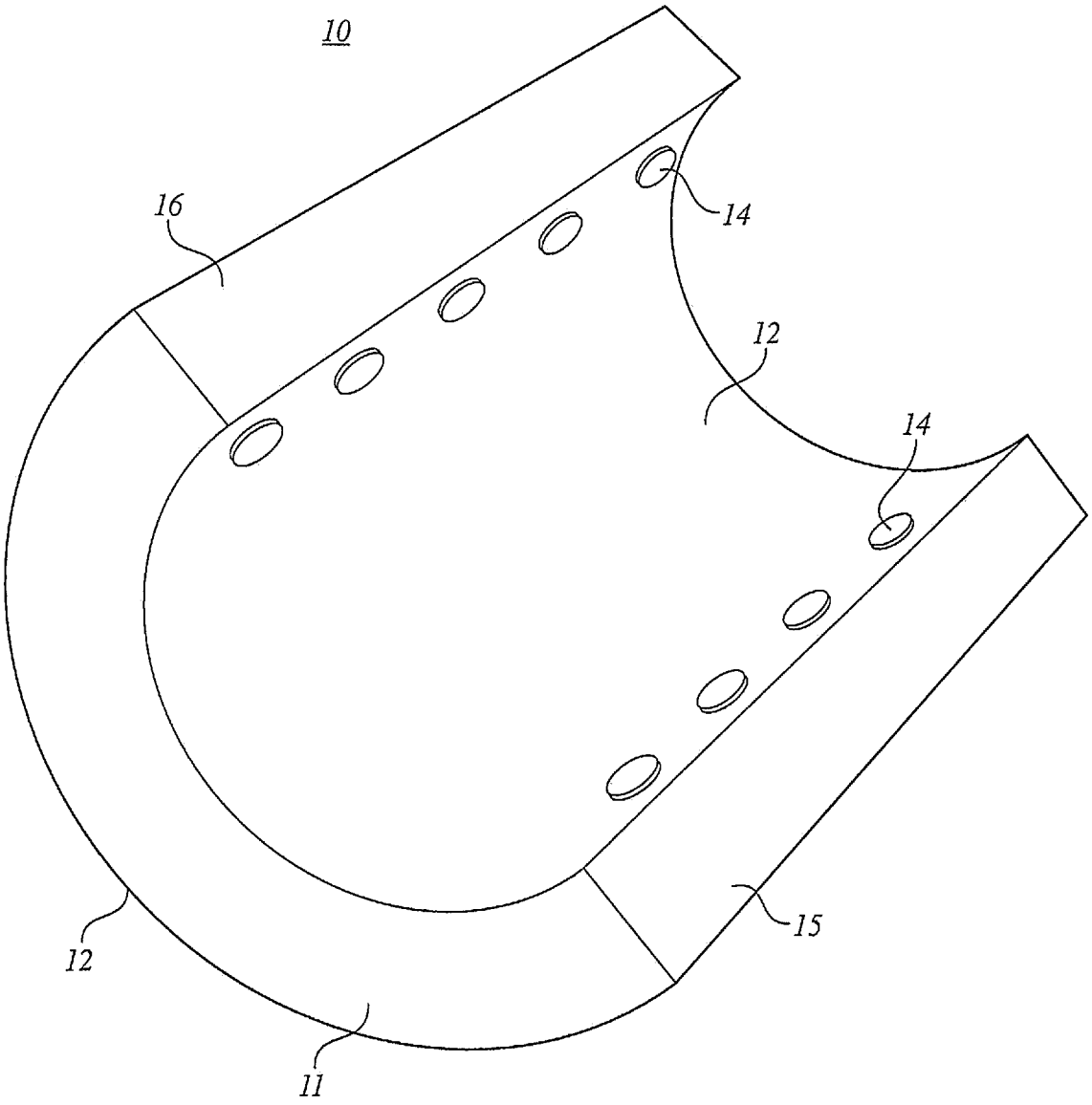
FIG. 3 shows a perspective view of one embodiment of a barbell pad that has been stretched out to show the inner surface and magnets on the pad.

Referring to FIGS. 1-3, in one embodiment of the invention, a barbell pad 10 uses magnets 14 to quickly attach onto the bar portion 21 of a barbell 20. The pad 10 is configured such that it does not slide back and forth, keeping its movement secure and tight. The inside portion 13 of the pad 10 is soft and durable, going back to its original shape as shown in FIG. 1 when resistance is applied when performing a exercise. A smooth outer surface 12 helps for an easy clean up when done.

Fasteners can be attached to the ends 15, 16 of the pad 10 such that the pad can be wrapped around and in contact with the outer circumference of the bar 21 as shown in FIG. 2. The fasteners can be hook and loop fasteners, such as for example Velcro, on the opposing ends 15, 16 of the pad which can be attached to the bar 21 such that the pad 10 produces no room for extra space, allowing the pad to be completely snug on a standard or Olympic size bar 21. In one preferred embodiment, the hook and loop fasteners are only used on the edges 11 of the pad 10 to fasten the ends 15, 16 of the pad 10 together so that the pad completely surrounds the circumference of the bar portion 21 of a barbell 20 as shown in FIG. 2.

In one preferred embodiment, nine magnets 14 are used as shown in FIG. 3. Five magnets 14 are attached near one end 16 of the pad 10, four magnets 14 are attached near the other end 15 of the pad 10 as depicted in FIG. 3. As shown in FIGS. 1 and 3, the five magnets 14 near one end 16 of the pad 10 and the four magnets 14 near the other end 15 of the pad 10 are disposed on the inner surface of the pad 10 in a pattern such that the magnets 14 near each end 15, 16 are offset from each other. In one preferred embodiment, the magnets 14 are placed about 3½ inches apart and near the ends 15, 16 of the pad 10. The magnets 14 are not facing each other when barbell pad 10 is wrapped and closed around the bar potion 21 of the barbell pad 10 as the magnets 14 need to contact and thus adhere through magnetic force to the metal bar potion 21 of the barbell 20 in order to secure the pad 10 to the bar 21. In one preferred embodiment, the magnets 14 used were Super Magnets available from retail stores and from the manufacturer Mast Magnetics, Inc. In such a preferred embodiment, the size of the magnets 14 are 0.709 inches diameter x 118 inches thick. The magnets 14 may be attached to the exterior of the pad 12 by using commercially available craft glue or other types of glue.

In one preferred embodiment, the inside portion 13 of the pad 10 is made of 2 cm thick high density foam. The exterior 12 of the pad 10 has a smoother finished surface for wiping of the pad 10 for cleaning purposes. In one preferred embodiment, the pad 10 is 15-18 inches long measured along the length of the bar portion 21 of the barbell 20.

Figure 4:
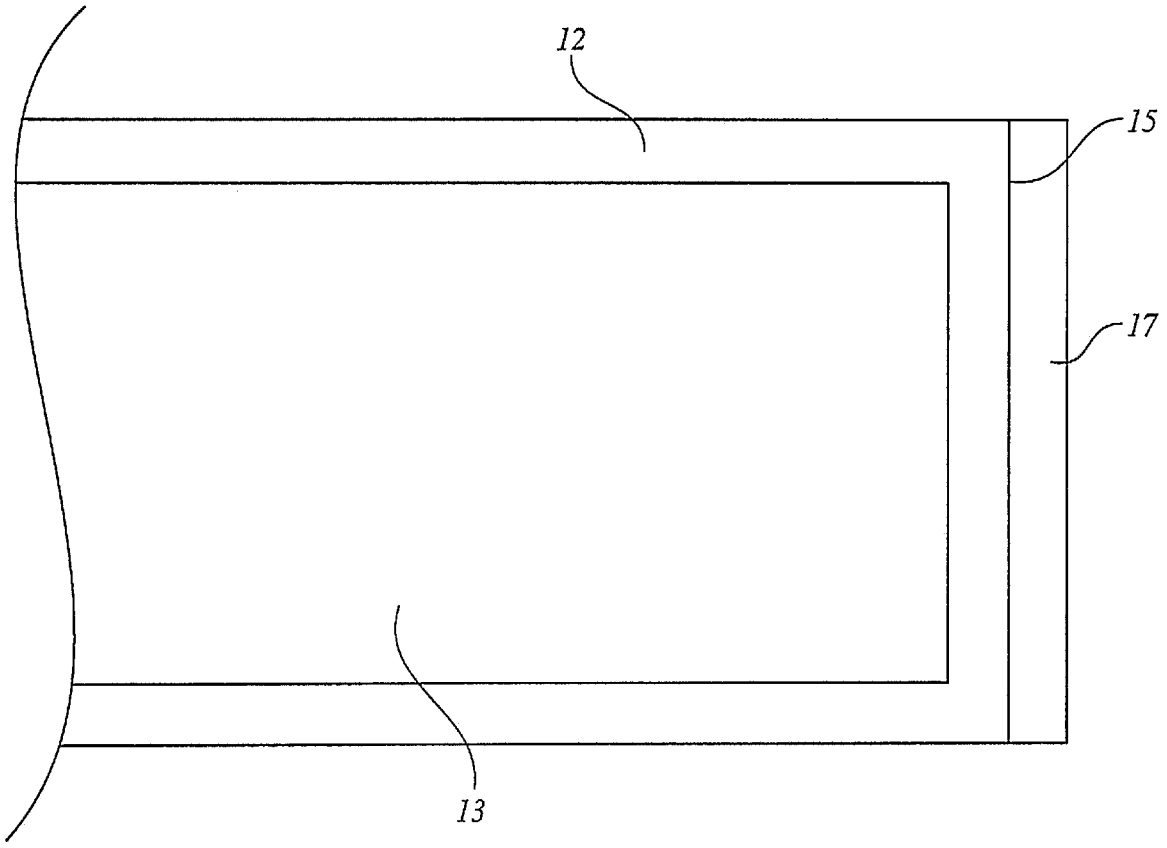
FIG. 4 shows a cross-section cutaway view of one embodiment of the barbell pad.

In on preferred embodiment as shown in FIG. 4, the exterior surface 12 of the pad surrounds and encloses the soft interior 13 of the pad. The fastener 17 is attached to the edge 15 of the pad 10.

The barbell pad 10 magnets 14 on its inner surface are used to better secure the barbell pad 10 to the bar portion 21 of a barbell 20 and prevent excessive slippage of the pad 10 relative to the bar 21 during use. In one preferred embodiment, the barbell pad 20 has an opening comprising two ends 15,16 lined with Velcro 17 that allows it to be fit around the bar 21 of a barbell 20 and secured around the circumference of the bar 21 when the Velcro 17 lining the two ends 15,16 of the opening is connected and magnets 14 on the inner surface of the barbell pad 10 attach to the metal bar's 21 outer surface. Magnets 14 attached the inner surface of a pad 10 or covering can be used to secure the pad or covering to a structure or apparatus to secure the pad or covering to the structure or apparatus and prevent slipping of the pad or covering relative to the structure or apparatus.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A barbell body protection apparatus comprising:

an inner surface configured to face a bar portion of a barbell, an outer surface, and two opposing ends including a first end and a second end;

a deformable interior portion disposed between the inner surface and the outer surface; and a plurality of magnets disposed on said inner surface configured to directly contact said bar portion and operably connect said inner portion surface to said bar portion of said barbell;

wherein said barbell body protection apparatus is configured to wrap around a circumference of the bar portion of the barbell such that the inner surface is configured to be in contact with and enclose said bar portion, and wherein said barbell body protection apparatus is configured to protect and comfort at least one of the neck and thighs of a user during exercise with the barbell;

further comprising fasteners on said opposing ends configured to ensure said barbell body protection apparatus wraps around the circumference of said bar portion of said barbell such that said inner surface is in contact with and encloses said bar portion when said fasteners on said opposing ends are engaged;

wherein said fasteners comprise a region of hook and loop fasteners.

2. The barbell body protection apparatus of claim 1, wherein said outer surface comprises a smooth material.

3. The barbell body protection apparatus of claim 1, wherein said magnets are disposed near the first and second ends of said barbell body protection apparatus in a pattern.

4. The barbell body protection apparatus of claim 1 wherein said magnets are disposed near the first and second ends of said barbell body protection apparatus in a pattern such that said magnets near the first end are offset from said magnets near the second end of the barbell body protection apparatus.

5. A method of securing a barbell body protection apparatus to a bar portion of a barbell comprising an outer surface, a deformable interior portion, an inner surface, and two opposing ends, wherein said barbell body protection apparatus is configured to protect and comfort at least one of the neck and thighs of a user during exercise with the barbell, said method comprising:

wrapping said barbell body protection apparatus around said bar portion of said barbell such that said inner surface is in contact with and surrounds said bar portion such that a plurality of magnets on said inner surface directly contact said bar portion and releaseably connect said inner surface to said bar portion through magnetic force;

further comprising securing said barbell body protection apparatus to said barbell by engaging fasteners on the two opposing ends of said barbell body protection apparatus such that said inner surface forms a cylindrical structure that surrounds and is contact with said bar portion;

wherein said fasteners comprise hook and loop fasteners that releaseably attach said opposing ends of said barbell body protection apparatus.

* * * * *